United States Patent [19]

Helling et al.

[11] Patent Number: 4,940,921

[45] Date of Patent: Jul. 10, 1990

[54] COMBINATION BALLAST AND COLD CATHODE SEALED LAMP AND METHOD

[75] Inventors: James C. Helling, Newport Beach; Anders W. Beckrot, Laguna Beach; Scott V. Murray, Huntington Beach, all of Calif.

[73] Assignee: LumiTech International, L.P., New York, N.Y.

[21] Appl. No.: 131,752

[22] Filed: Dec. 11, 1987

Related U.S. Application Data

[63] Continuation-in-part of Ser. No. 891,263, Jul. 28, 1986, Pat. No. 4,751,434.

[51] Int. Cl.[5] ..... H05B 41/26; H05B 41/36; H01F 27/28

[52] U.S. Cl. ..... 315/219; 315/209 R; 315/226; 336/172; 336/182

[58] Field of Search ..... 315/200 R, 208, 209 R, 315/219, 220, 221, 222, 223, 226; 336/172, 173, 178, 180, 181, 182, 183, 185, 226; 363/133

[56] References Cited

U.S. PATENT DOCUMENTS 4,307,334 12/1981 Peil et al. ..... 315/219 X 4,700,111 10/1987 Folwell et al. ..... 315/200 R 4,751,434 6/1988 Helling et al. ..... 315/183

*Primary Examiner*—David Mis

*Attorney, Agent, or Firm*—Willian Brooks Olds Hofer Gilson & Lione

[57] ABSTRACT

A miniature, light weight, high voltage, high frequency, high power output unique ballast and a unique sealable neon lamp in a light weight, light reflective box containing the ballast for use as one of a plurality of ceiling lamps. The ballast includes a transformer with a tuned secondary due to distributed capacitance, as a result of spaced apart first and second halves of the secondary winding, particularly wound in three separate sections of a bobbin fitted on the center leg of the transformer E—E core and tightly coupled to a center tapped primary winding on the center leg of the other section of the E-core. The section of the core are separated by a high dielectric spacer which also gaps the core when the sections are placed together. An asymetrical starting circuit prevents burnout of the alternate conducting FET switching device by insuring that only a selected one FET always starts first, and the unique bobbin and secondary winding prevents breakdown in the secondary high voltage winding.

7 Claims, 13 Drawing Sheets

COMBINATION BALLAST AND COLD CATHODE SEALED LAMP AND METHOD

This is a continuation-in-part of copending U.S. patent application Ser. No. 891,263 filed 07/28/86 entitled "Self-Illuminated Sealed Cool Light Display and Method" by Helling et al., now U.S. Pat. No. 4,751,434.

BACKGROUND OF THE INVENTION

1. Field of the Invention

The invention is a miniature, light weight, high voltage, high frequency, high power output ballast, particularly adapted for use with cold cathode lights, and herein concealable within and useful with a unique sealed neon lamp structure.

2. Description of the Prior Art

U.S. Pat. No. 4,700,111, issued Oct. 13, 1987 to Folwell et al, and entitled HIGH FREQUENCY BALLAST CIRCUIT is typical of high frequency switching circuits of the prior art.

The design of this prior art circuit is based upon the use of a U—U core. Applicants have substantially improved efficiency, and output power to size, including tighter coupling by using an E—E core with entirely different winding structures. Also, applicants have extended the range of their miniature ballast for nominally handling 2' to 26' and even 30', 12 mm diameter, neon lamps, rather than the 10' lamps of the described prior art. U.S. Ser. No. 06/891,263 now U.S. Pat. No. 4,751,434 by Helling et al discloses sealed displays including cold cathode tubes.

SUMMARY OF THE INVENTION

It is an object of this invention to provide an asymetrical starting circuit for switching cold cathode lamps to avoid circuit burn-out when more than a single switching device is initially turned on, simultaneously.

A further object is the provision of an E core system which vastly improves over all prior art system.

Another object is the synergistically combined ballast and cold cathode lamp in a sealed box suitable for use as a single lamp unit of a plurality of many lamp units repetitively associated to comprise ceiling lighting in an edifice.

The foregoing is achieved by locating the primary winding and the split secondary winding on the center leg of an E core, separated by an oversized dielectric film of KAPRON P-221 with the core window being filled for optimum tight coupling.

The secondary winding is wound on spaced apart sections of a highly dielectric bobbin with a gap therebetween to form distributed capacitance useful in tuning the transformer output for maximum power transfer to the lamp load. To avoid breakdown, the cross-over section of the secondary winding spanning the gap is reverse wound. The bobbin with the secondary winding is vacuum impregnated with EPOXY-LITE resin and quadruple insulated, dielectric strength of 3000 volts, #36 gauge wire is used to wind the secondary.

A standard UL rated 110/220 to 24 volts remote transformer supplies 24 ac to accommodate a plurality of such lamps. The lamp is housed in a molded 2'×2' by 3" thick light weight polyethylene such as STYROFOAM, sealed across the mouth with a lens diffusing or otherwise. The combination is a lightweight sealed overhead lighting unit operable from a low ac or dc voltage. Low cost provides a disposable lamp including the ballast.

DESCRIPTION OF THE PREFERRED EMBODIMENT

In general, the high voltage high frequency power supply the present invention is a current sensing circuit which accommodates from 2 feet of cold cathode tubing up to 30 feed of tubing. This circuit may be powered by 24 v a.c. 50–60 hz or 24 v d.c. The high voltage power supply also permits the input voltage to be varied. The ability to run the high voltage power supply on a.c. or d.c.. varying the input voltage provides for a.c. input and d.c. stand-by powwer at 24 v d.c. onhalf power 12 v d.c.. The power supply may operate satisfactorily with no load or shorted load. This precludes technicians or maintenance men from burning out the ballast because they usually test to determine if the circuit is "alive" by shorting the secondary output. The high voltage power supply has its own line filter to prevent frequency noise from getting back into the power a.c. line. The high voltage power supply runs at for example 38 khz and at 5 kv, depending on the output load, ie the number feet of tubing.

Figure 1:
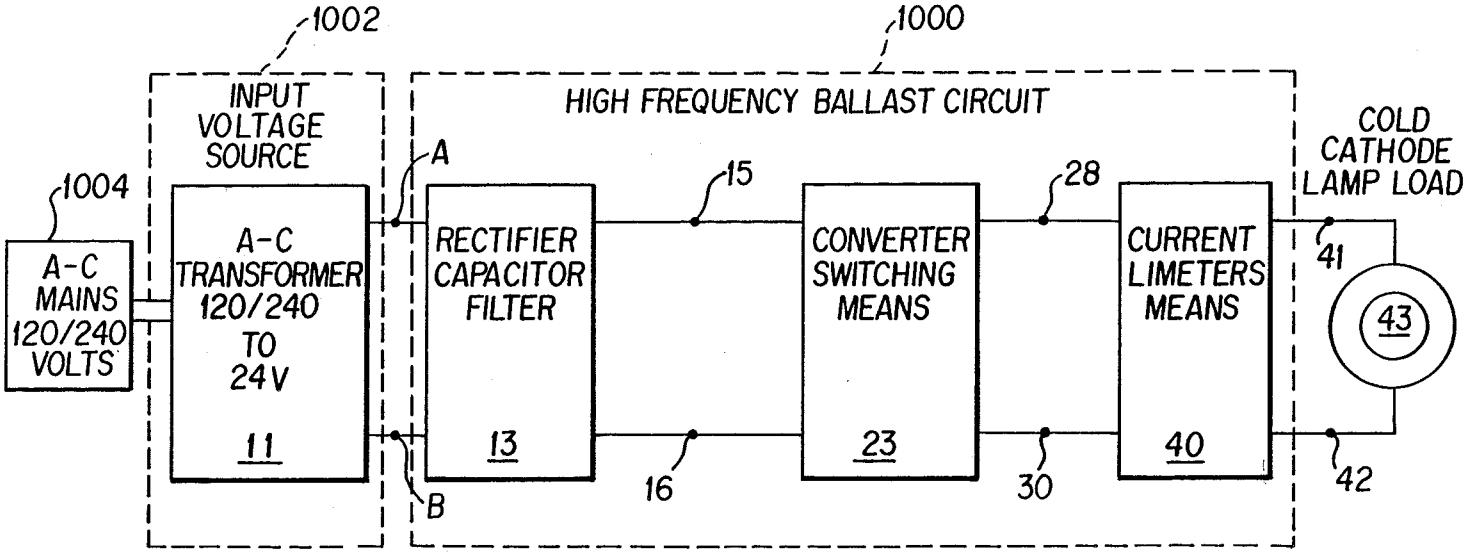
FIG. 1 is a block diagram of a common voltage source, a ballast circuit and a cold cathode lamp load.

In FIG. 1, the high frequency ballast circuit 1,000, comprises a.power converter switching means 23, having first and second output terminals 28,30, for converting power coupled from the input voltage source circuit 1,002 first and second power input terminals 15,16 and received via rectifier capacitor filters to a relatively high frequency quasi-sinusoidal voltage at first and second output terminals 28, 30. The power converter second output terminal 30 is coupled to the high frequency load circuit second power output terminal 42.

Figure 2:
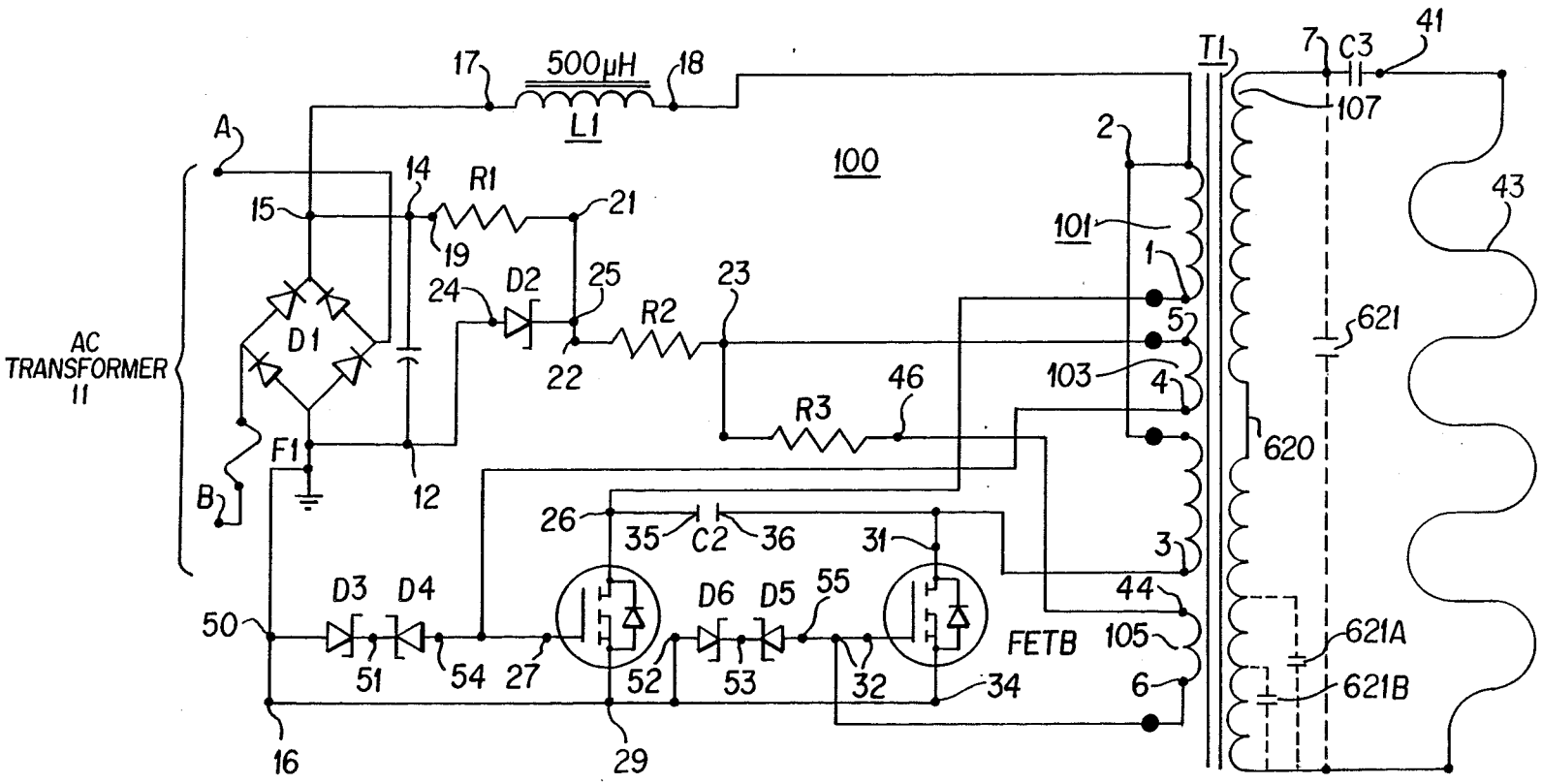
FIG. 2 is an electrical circuit diagram of the simplified circuit with load.

A current limiter means 40, is provided for current limiting between the power converter first output terminal 28 and the high frequency circuit first power output terminal 41. This starting and current limiting circuit means 40 usually a capacitor C3. FIG. 2 additionally provides a predetermined reactance between the first power converter output terminal 28 and the high frequency circuit first power output terminal 41 to limit current through the cold cathode lamp load 43.

The circuit of FIG. 1 is capable of driving a cold cathode neon lamp equivalent to the VOLTARC 4500 kelvin white. A-C mains 120/240 volts 1004 supplies input voltage to step down transformer 11 which in turn applies 24 volt A-C to terminals A and B. The starting mode of operation proceeds from the time the a.c. or d.c. input power is applied across terminals A,B (FIG. 1) or terminals A and B of FIG. 2 because the cold cathode lamp 43 ionizes. Ionization of the lamp 43 typically commences when the voltage across the lamp load 43 (FIGS. 1 and 2) exceeds 10,000 volts peak to peak. The lamp load 43 between secondary terminals 7 and 8 presents a very high resistance to the driving circuit, after ionizing and entering the operating mode, the lamp load 43 resistance drops, the tubing operating as the resistive load, the voltage across the lamp being limited to a peak value, depending on the lamp load applied to the circuit, the length of tubing, the tubing diameter, the temperature within the tube, the type of gas etc.

The power converter circuit 23 (FIG. 1) is typically designed to operate at 39 khz + or −10%, depending on the lamp load during start-up. After the tube 43 warms up, the frequency drops to 37 khz + or −10%, depending on the tube dimensions.

Figure 4:
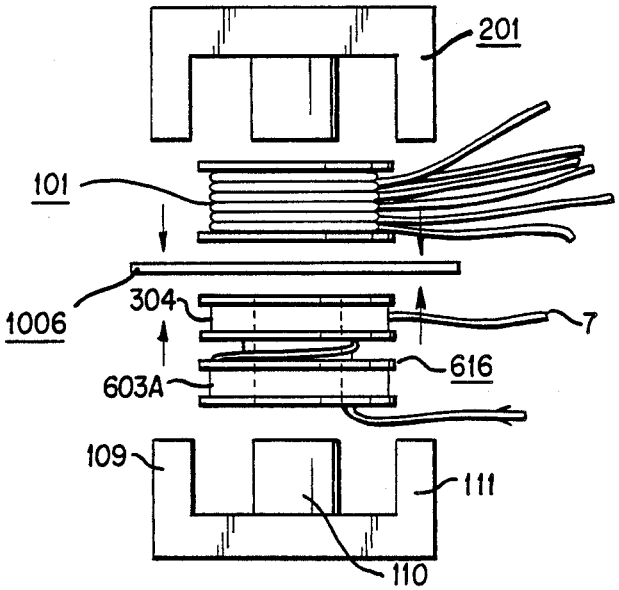
FIG. 4 is an exploded view of the E core showing all windings.
Figure 5:
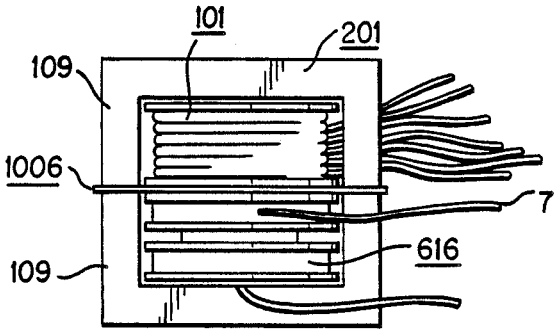
FIG. 5 shows the components of FIG. 4 in operative relation.
Figure 6:
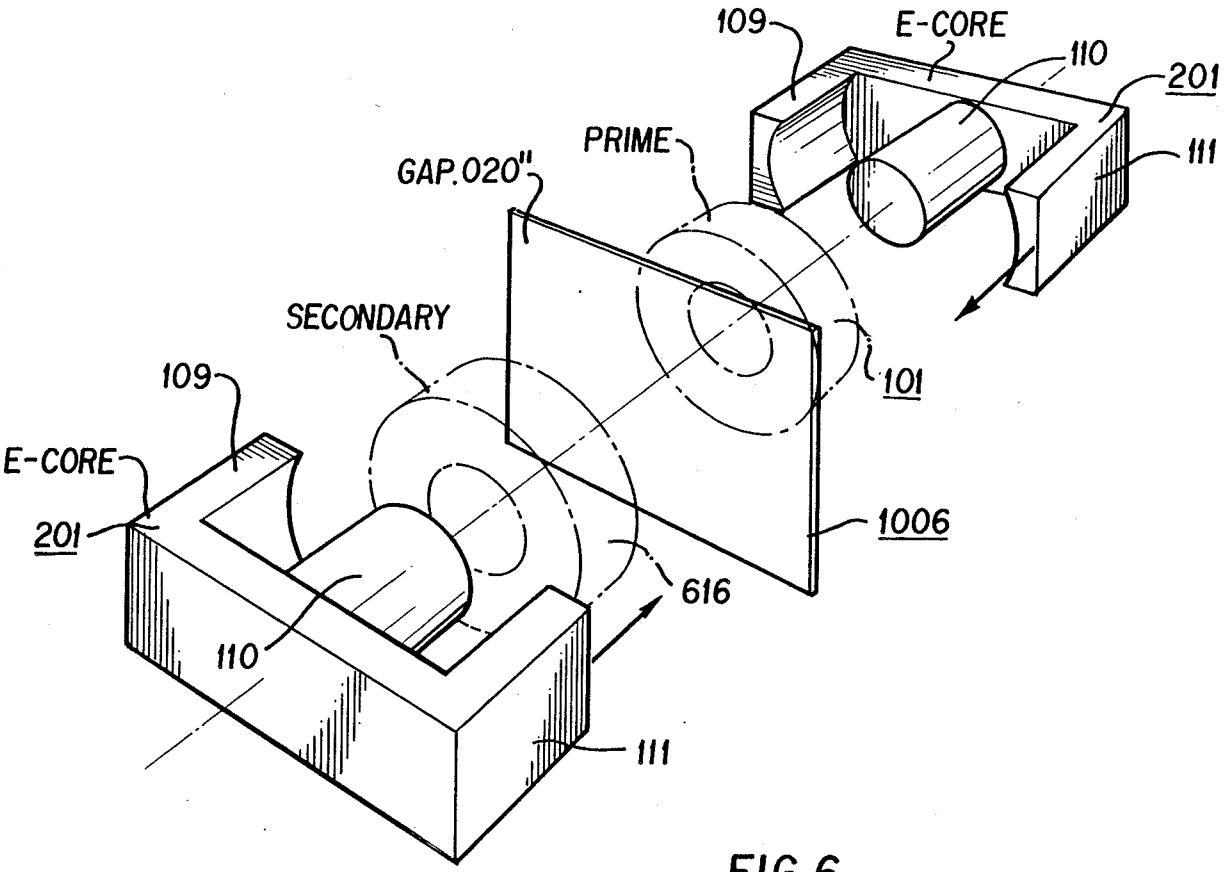
FIG. 6 shows the components of FIGS. 4 and 5 in exploded perspective.

The circuit of FIG. 2 has a transformer T1 having an 18 turn center tapped primary winding 101 and two feedback windings 103 and 105, each having 3 turns. The transformer T1 secondary includes 1100 turn secondary winding 107. All windings are mounted on a ferrite E core 201 (FIGS. 4 and 5) having two sections (standard industry part no. N27X129). Each outer leg 109,111 and the center leg 110 are gapped 0.20 inches by Dupont KAPTON dielectric film 1006 (FIG. 4). The wire used is 18 gauge on the primary winding 101 and 36 gauge on the secondary winding 107 and 22 gage on the feedback windings 103,105. The inductor L1 used is a ferrite inductor (standard industry part no. 9677182209) with an 18 gauge wire of 88 turns.

The n-channel enhancement-mode power field-effect transistors, FET A and FET B (for example, RCA part no. RFP8N20) have a min. drain source breakdown voltage of 200 v, a gate threshold voltage of min. 2 v and 4 v max., switched on resistance of 0.5 ohm of 4 v. rated at 8 amps, operating temperature −55 c. to +150 c.

The C2 capacitor (for example, American Capacitor Corp. part no. PR3D683J) for switching conduction between FET A and FET B is a 0.068 MFD + and −5% at 200 v (for example, American Capacitor Corp. part no. PR3D683J). It is a fast recovery device with a suitable reverse voltage rating.

The Zener diodes D3,D4,D5,D6 (standard industry part no. 1N5242) 12 volt at ¼ watt, and comprise the junction between the gates of FET A and FET B and ground diodes, D3 and D4 are connected cathode to cathode and anode to ground, and anode to the gate 27 of FET A.

Diodes D5,D6 are cathode to cathode and anode to ground and anode to the gate 32 of FET B. The Zener diode D2 holds point 25 at 3.9 volts and is a zener (standard industry part no. 1N5228). This voltage, in conjunction with the drop across R1(4.7K) is a voltage divider to hold a constant 3.9 v at terminal 22 of R2 (470 ohm), R2 is connected to feedback winding 103 at point 5. The other end of R2, point 23, is tied to one of the feedback winding 103 at point 5 and also to terminal 45 R3(100 ohm).

R3 terminal 46 is tied to 105 feedback winding at point F44.

Voltage drops across R2 and R3 generate the field voltage in the feed back windings for FET A and FET B gates 27 and 32.

A current limiting means comprise the capacitor C3 between terminals 7 and 41. The capacitor C3 (standard industry part no. RMC 50-5% N1500) is a 6 kv 50 pf suitable for start up and current control of the lamp or tube 43 for lengths usually under approximately 20'.

This capacitor is located on the finish side 7 (FIG. 4) of winding 107 comprising the secondary of transformer T1. For lengths over approximately 20 feet in length or in other tubes that have a high resistance, it is possible to remove C3, because of the characteristics of FET A and FET B, and the design of the secondary bobbin 616 (FIGS. 7 and 8), which make this possible in the present invention.

Figure 7:
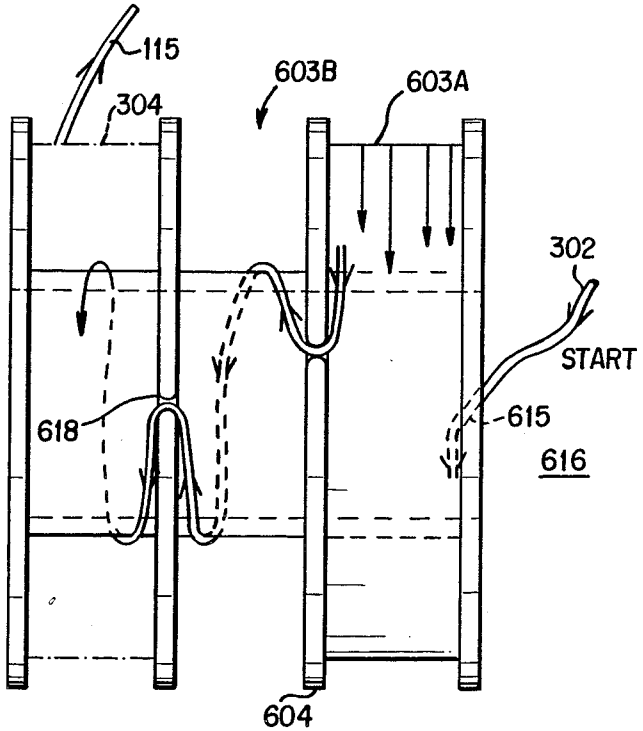
FIG. 7 shows a front view of the secondary winding and supporting bobbin therefor.

FIG. 7 shows the unique bobbin 616 used in this invention to hold the secondary winding 107 and isolate it from high voltage breakdown. The bobbin 616 is made of Dupont RYNITE which allows for the highest dielectric strength of 600 v per/mil.

Figure 7A:
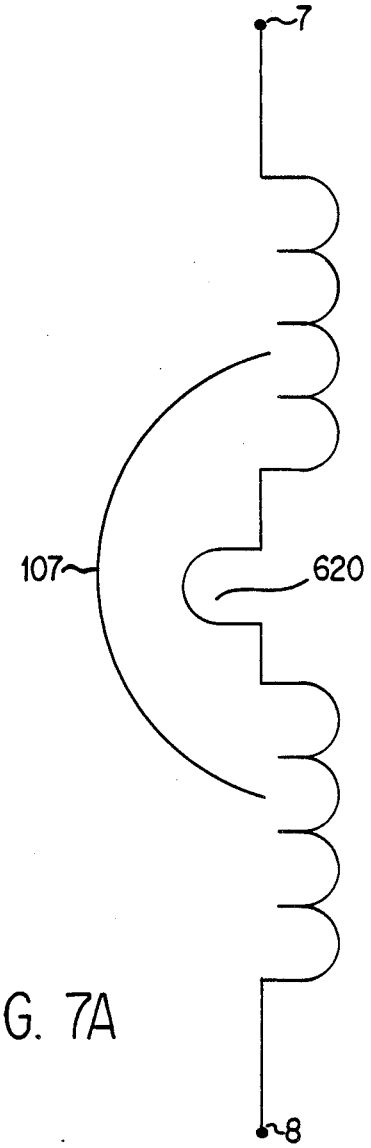
FIG. 7A shows the two halves of the secondary winding polarized relative to the crossover turn.

In FIG. 7A The bobbin 616 has three sections 603 A, 603 B, 603 C the start section 603 A, a reverse cross-over capacitance section 603 B, and a finish section 603 C. The O.D of the bobbin 616 is 1.250" The core 601 of bobbin 616 is 0.594 inches in diameter. The core bobbon winding area has a diameter of 0.688" the wall thickness is 0.047" on all walls, the start hole 615 (FIG. 8A) is a 45 degree downward penetrating opening of 0.016" diameter and the center cross over spacing or slot 618 has a width of 0.172", while the width of sections 603 A and 603 C are 0.141". The width of the spaces (e.g.) 604, 605 is 0.047".

Figure 8:
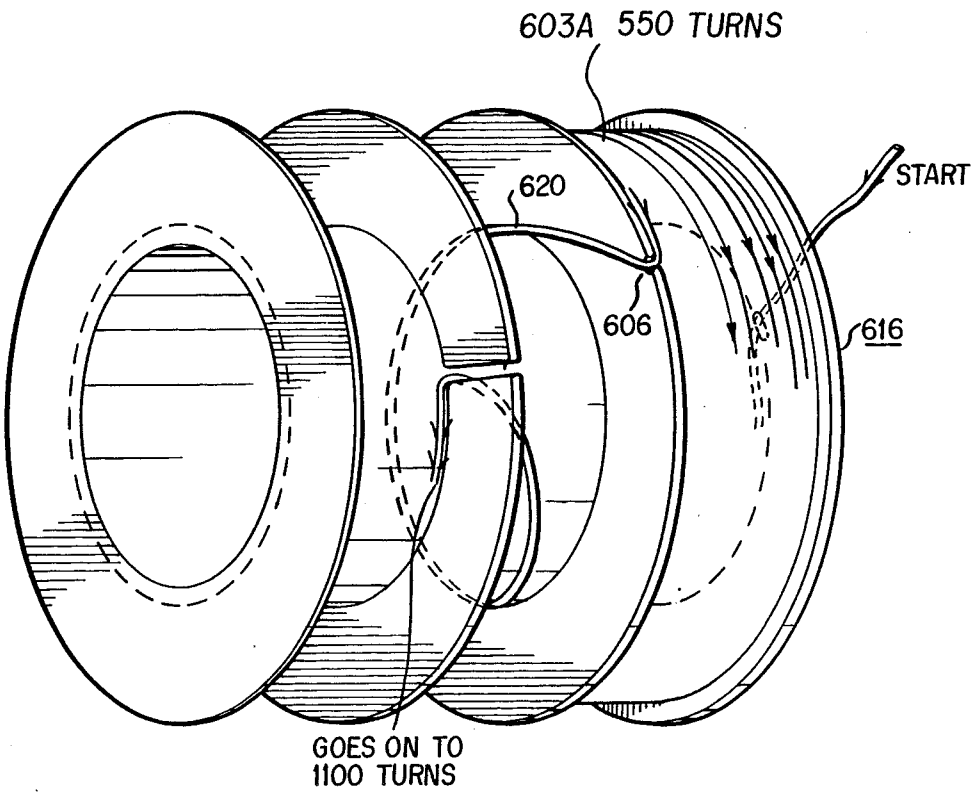
FIG. 8 is a view in perspective of the bobbin of FIG. 7.
Figure 8A:
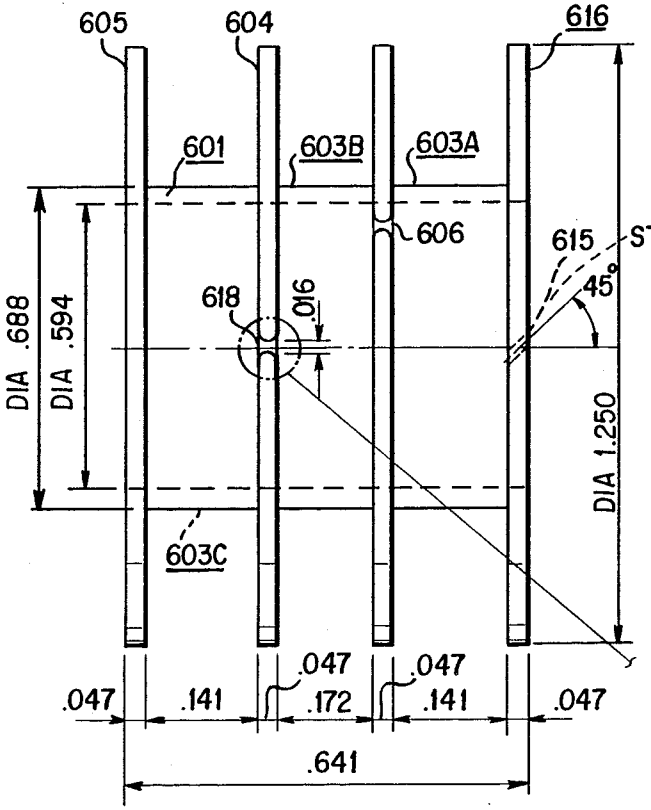
FIG. 8A is a side view of the bobbin, perse.

Looking at the FIGS. 7, 7A and 8A, the winding 107 enters start hole 615 and proceeds in a counter clockwise direction about spool 601 for one half of the winding 107.

Figure 9:
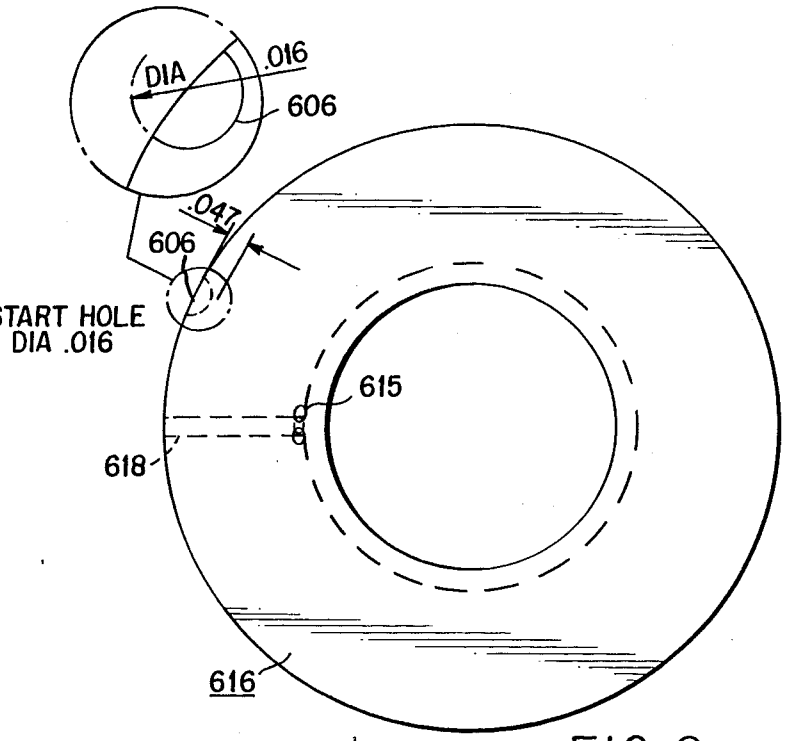
FIG. 9 is a side view of the bobbin of FIG. 8.
Figure 10:
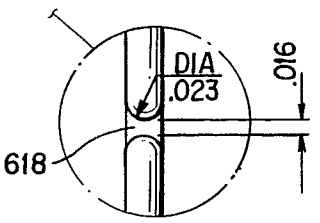
FIG. 10 is an expanded detailed view of a portion of the bobbin.

In the structure of FIGS. 8–10, the cross-over slot 615 (see 620 FIG. 2) is shown guiding the wire of secondary winding 107 across the cross-over of the second half of the secondary 107 The cross-over turn 620 (FIGS. 8 and 8A) of section 603 B is 180 degrees out of phase with the first and second half of the secondary winding 107. This one turn 620 enters the cross-over section 603B via peripheral notch 606 in spacer 605 and turned the opposite direction (i.e) clockwise to encircle the core 601 section 603 B once. Thus, this turn is a step down one turn which allows for a higher isolation cross over. Spliting the secondary winding 107 into two equal halves (FIG. 2) accounts for a capacitance 621, shown as a distributed capacitor made up of the elemental capacitors 621 A, 621 B, etc. with C3 as the current limiting means. Capacitor 621 appears to tune the secondary for a much greater output with a higher degree of isolation, and is the means permitting the circuit to accomodate 2 feet to 30 feet of neon tube 43 and providing for an open or closed secondary 107 on T1.

Figure 3:
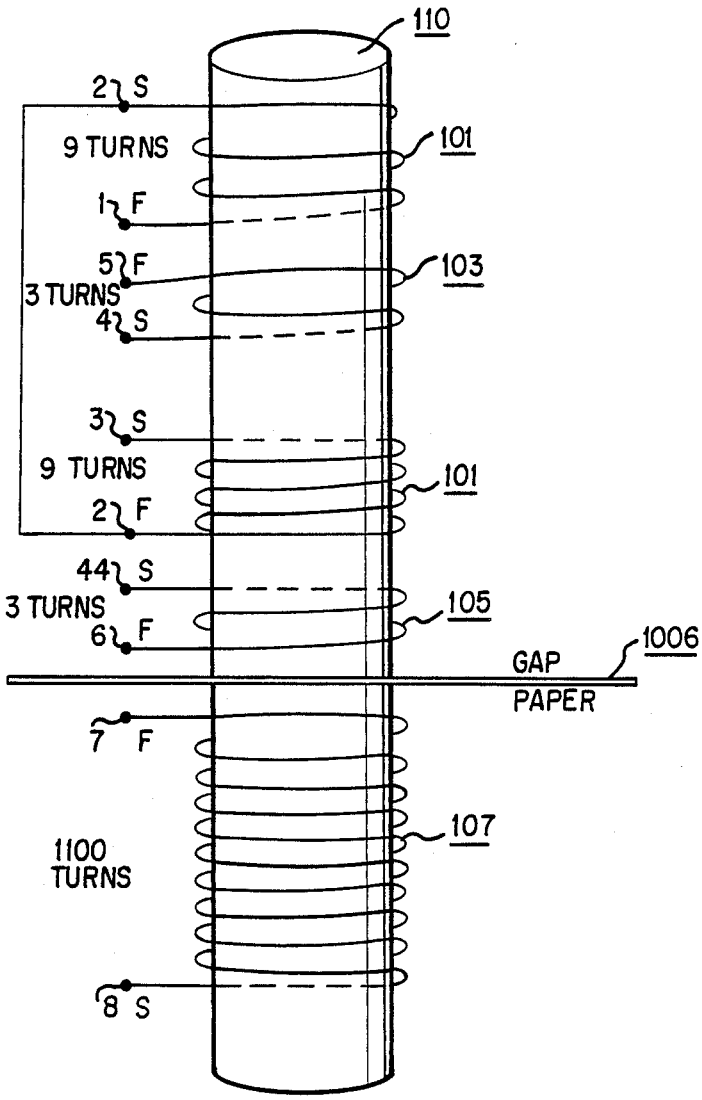
FIG. 3 shows the center leg of an E core with all windings used in FIG. 2.

The purpose of FIG. 3 and FIG. 7A is to show the relative polarities of the windings of the device of the present invention, and their interactions. Thus, in FIG. 7A, it will be seen that the multi-sectioned bobbin 616 (FIGS. 7 and 8) permits the two halves of secondary winding 107 to be polarized opposite to single turn 620.

With this in mind, FIG. 7 shows the 180 reversal of turn 620 in cross-over section 603B. The cross over slot 603 B is rounded and permits the wire to interpose dielectric space 604 as it turns 180, thereby avoiding a large breakdown voltage. Also, the quadruple insulated #36 wire and using epoxy materials in a vacuum impregnated system applied to the winding 107 synergistically avoids breakdown.

FIG. 3 shows the start(s) and finish (F) ends of the windings on center leg 110 of the magnetic E-core 111, as well as the finish paper Dupon KAPTON film 1006 for insulating the secondary from the primary. Thus, advantages realized in using the E-core 201 in FIG. 4 with split secondary 107 of T1 with close coupling in FIG. 5 of the primary 101 to secondary 107 and reverse phasing of the cross-over 620 in FIG. 8 of the secondary 107 of T1 in conjunction with fast on and off time FET A and FET B exhibiting clean switching only a bare minimum amount of R.F. leakage from the high voltage power supply is experienced. Also, the selected E core 210 in FIG. 4 and specified FETS permit a much greater current output then the normal high frequency switching power ballast.

Following through the converter block 23, as shown in the circuit diagram of FIG. 2 there is shown a first zener diode D2, having an anode 24 and a cathode 25; a pair of semiconductors such as fet A and fet B each having a conductive channel, such as the path from the FET A drain 26 to the FET A source 29, and from the FET B drain 31 to the FET B source 34. The circuit 23 (FIG. 1) also includes reverse chargeable capacitor C2 (FIG. 2) having a first terminal 35 and a second terminal 36.

A transformer T1 is shown having a primary winding 101 having first and second terminals 1 and 3 and a center tap 2, a secondary winding 107 having first and second terminals 7 and 8 and a feedback winding 103 with first, second, third and fourth terminals 4 and 5, 44 and 6. The feedback winding 103 and 105 supplies the gate drive current for FET A and FET B.

The secondary winding 107 between terminals 7 and 8 is coupled to converter primary winding shown having first and second terminals 1 and 3 with its center tap identified at 2.

A first resistor R 1 having a first terminal 19 is coupled to the first power input terminal 15 and to the inductor L1, first terminal 17. Terminal 21 of resistor R1 extends to converter first zener diode cathode 25.

Converter second resistor R2, first terminal 22 is connected to R1 terminal 21 and to R3 first terminal 45.

When power is applied to terminal A and B (FIG. 2) bridge-rectifier D1 applies plus 31 volts to point 15. Zener diode D2 conducts above 3.9 volts, as a result of current flow through R1 and R2, feed back winding 103 to gate of FET A and ground via back to back coupled zener's D3 and D4. This applies for a 5 millisecond, 20 volt waveform to gate 27 of FET A.

The converter third resistor R3, second terminal 46 is connected to the feedback winding 105.

The transformer center tap 2 is coupled to the inductor L1 second terminal 18. The power converter second resistor R2 second terminal 23 is coupled to the third resistor R3 terminal 45 and coupled to the feedback winding 105 at terminal 44.

The second FET B drain 31 is coupled to the transformer primary first terminal 3. The first FET A drain 26 is coupled to the transformer primary first terminal 1. The first FET A and second FET B have their sources 29, 34 are coupled to the power converter circuit first zener diode anode 24 and to the second power input terminal 16 (ground).

FET A gate 27 is coupled to the transformer feedback winding 103 second terminal 4. FET B gate 32 is coupled to the second terminal of the feedback winding 105 at terminal 6.

The voltage and frequency converter capacitor C2 first terminal 35 is coupled to the transformer primary first terminal 1, and the converter capacitor C2 second terminal 36 is coupled to the transformer primary winding second terminal 3.

Also, in FIG. 2, the first terminal anode side of zener diode D3 50 is connected to junction 16. The first anode side 56 of zener D6 is also grounded at 16. The second terminal cathode side 4 D3 is connected to the cathode 51 of D4. The second terminal of D6 (cathode side) is connected to cathode 53 of D5. The third terminal anode 54 D4 is connected to the gate 27 of FET A. The third terminal 55 of D5 anode is connected to FET B 32.

The phasing relationship between the transformer primary and the feedback winding is adapted alternately to drive each FET into conduction whereby switching is established.

Figure 2B:
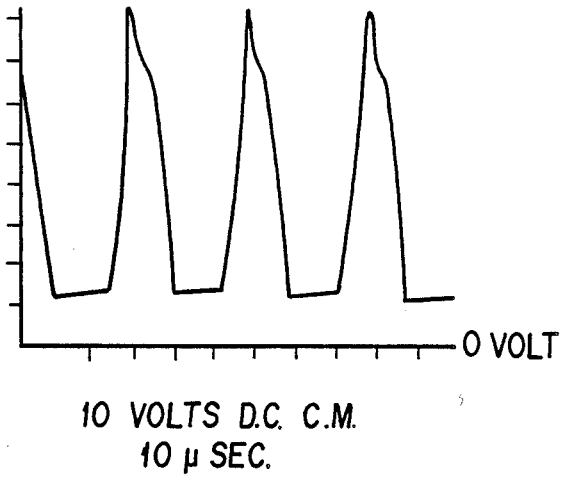
FIG. 2B shows the corresponding waveform for the other switching FET.
Figure 2A:
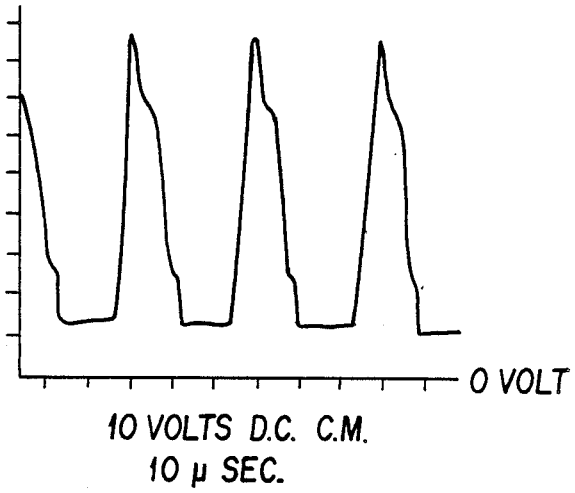
FIG. 2A shows a clean switching waveform depicting the on/off times of the intial starting FET.

Now, refering to FIGS. 2A and 2B, respectively picked up from points F and G, show the switching rise and fall times of FETS A and B. Note that the on times are abrupt, but that the rise time in FIG. 2A for FET A is faster than FET.B of FIG. 2B. This is because R3 is in the gate path of FET B which always causes it to switch second to FET A. This asymetrical starting circuit intentionally limits the current to the FET B gate whereas there is no comparable resistor in the gate path to FET A so it always turns on first.

The asymetrical starting circuit prevents FET burn out by insuring that the two FETS can never turn on at the same time.

Typical values of the components of FIG. 2:

R3 RESISTOR ½ WATT 5% 100 OHM
R1 RESISTOR ½ WATT 5% 4.7 K
R2 RESISTOR ½ WATT 5% 470 OHM
C1 CAP, ALUM EL, 50 V 1000 UF
C2 CAP, POLYPROP. 200 V 0.068 UF
C3 CAP, DISC. CER, 6 KV 50 PF
D1 DIODE RECT. 50 V 5 AMP.
D2 ZENER DIODE 3.9 V ½ WATT
D3 ZENER DIODE 12 V ½ WATT
D4 ZENER DIODE 12 V ½ WATT
D5 ZENER DIODE 12 V ½ WATT
D6 ZENER DIODE 12 V ½ WATT
FET A 200 V 8 AMP
FET B 200 V 8 AMP

OPERATION

The ballast converter of FIG. 2 performs the switching or oscillation function using transformer T 1, capicitor C 2, FETS A and B and choke L 1.

The gates 27 and 32 of the FETS are supplied with a fixed dc voltage of approximately 3.9 volts from point 21 of the R1, R2 voltage divider. The 100 ohm resistance R3, drops the gate potential of FET B below that of FET A.

The presence of R 3 has been explained as preventing FET B from turning on during start up of the conveter when FET A is conducting.

Once the switching action takes place, feedback drive windings 103 and 105 operate at low impedance out of phase signals summig with the necessity for the 3.9 volt gate supply.

The voltage across primary winding 101 is 180 volts peak to peak and is a quasi sinusoidal waveform.

The voltage across secondary winding 107 is approximately 10,980 peak to peak volts before breakdown and is almost sinusoidal to drive lamp 43.

When a 24 volt dc or ac voltage is applied across terminals A B of FIG. 2 and FIGS. 2A and 2B, the bias circuit by way of feedback winding 103 applies a higher gate voltage to FET A than FET B so FET A conducts due to the positive voltage from choke L1 terminal 18 via upper half of primary 101 terminals 2 to 1. The resulting induced voltage in feedback winding 103 across terminals 5-4 establishes conduction in back to back zeners D3,D4 to FET A gate 27. At tihs time, the phasing of 103 and 105 changes phase signal from 103 to 105, to allow FET B to turn on via gate signal 32. At this time switching has started. FET B turns on because its drain 31 FIG. 2B is receiving positive voltage via the other lower half of primary winding 101 and its gate is positive due to the voltage divider R 1,R 2.

Capacitance C 2 comprises reactance timing means which charges and discharges to control the frequency of oscillation.

LAMP LIGHT

Figure 12:
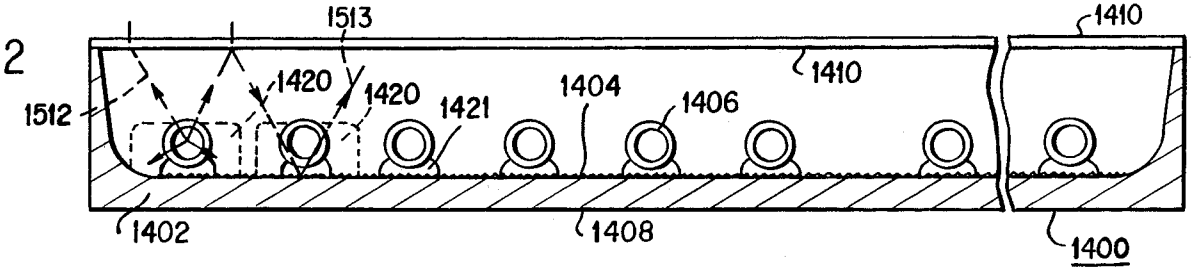
FIG. 12 depicts a light lamp in cross-section.
Figure 13A:
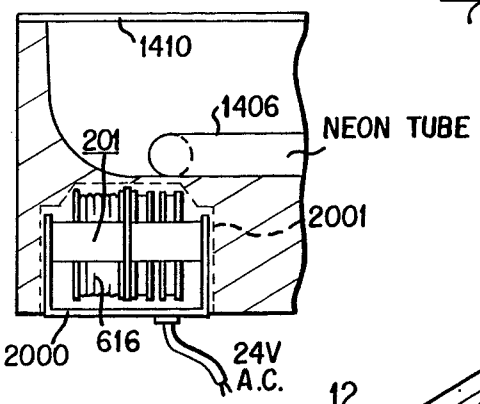
FIG. 13A depicts a ballast cross-section.
Figure 13:
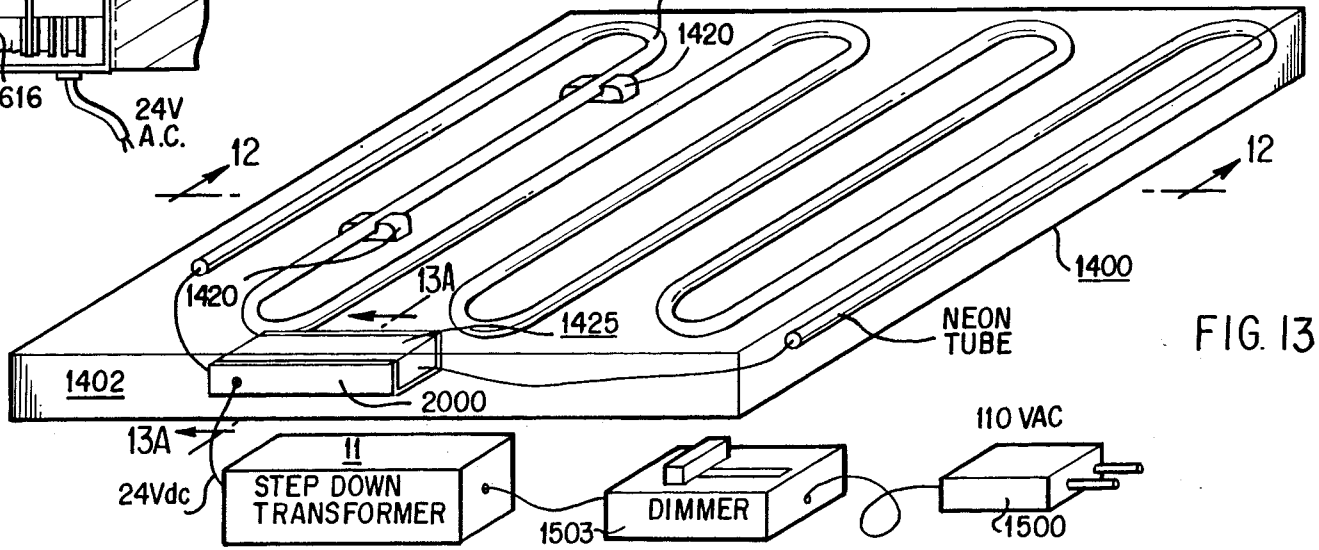
FIG. 13 is a perspective view of a light lamp including the ballast.
Figure 14:
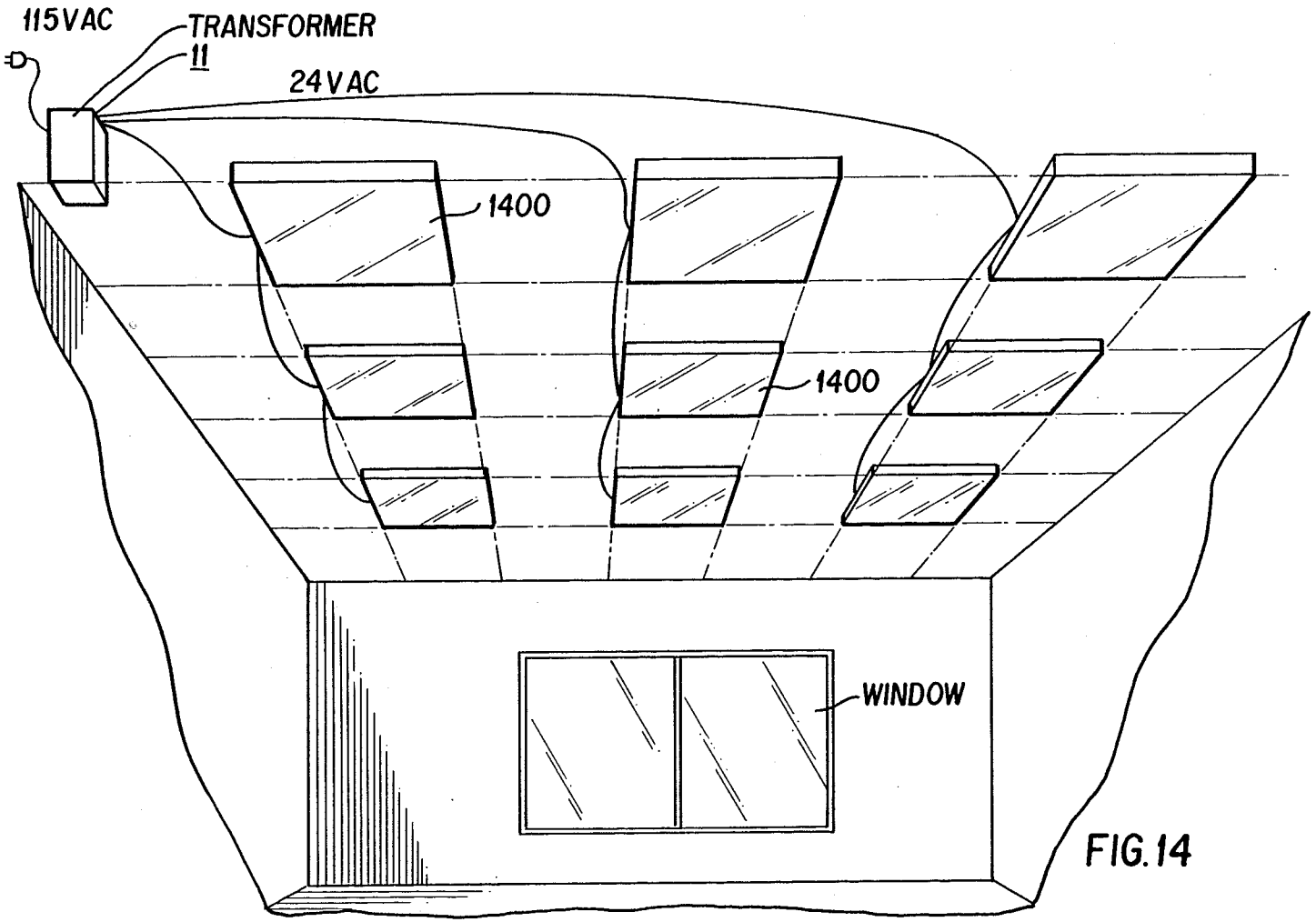
FIG. 14 is a view, in perspective, of a plurality of light lamps forming a suspended ceiling and all operated from a single step-down transformer.

The lamp light of the invention is represented by each of the nine squares 1400 of FIG. 14 which depicts a lighted false ceiling using conventinal frame support. The details of lamp 1400 are shown in FIGS. 12, 13 and 13A.

The lamp light box or housing 1402 is made of light weight polyethylene, such as STYROFOAM of the type using fireproofing chemicals in the mixture to be extruded. These extrusions can be manufactured by ARCO Chemical Company via MARKO Foam Products, Inc. 1441 So. Village Way, Santa Ana, Calif. 92705. Applicants supply the housing specifications for box 1402. This box measures 2' by 2' by 3" deep and weighs about 8 oz.

It has a white interior, due to the material, and it can be painted or coated to alter its light reflecting qualities. FIG. 12 shows optional interior coating 1404.

The combination of the styrofoam box bottom and a light lense diffuser across the mouth of the box, which resolves the short gap problem, to ensure maximum ouput light and uniform briliancy from the lamp light.

The glass tubing 1406 is configured in an array to extend across the box 1402 adjacent the bottom 1408 thereof, as shown in FIG. 12. When the lamp is used as a light in a ceiling the bottom 1408 is of course disposed upwardly in order that light can be directed and reflected through lens 1410 down into the room to be lighted. Box 1402, together with lens 1410 is a sealed disposable lamp.

Generally, lens 1410 is a very light conventional acrylic diffuser which is glued to the box edges, sold by KSH., Inc., Tustin, Calif. and others.

By way of example, conventional neon tubing 1406 may be purchased in the form of a neon light in lengths specified e.g. 20 lengths.

The neon tubing 1406 may be simply contained or retained by molded lamp holders which receive the tubing in a press fitting manner.

Any silicone glue may form the mounds 1421 as an alternate mounting structure or both methods may be used, particularly in high vibrational areas.

The ballast 1425, in the aluminum trough-like heat sink 2000, is contained in recess or cavity 2001 in the box 1400. Ballast 1425 is press-fit or otherwise retained in cavity 2001 with the heat sink exposed to the exterior ambiant for liberation of heat.

Electrical plug 1500 (FIG. 13) applies power to STEP DOWN transformer 11 via dimmer 1503 to supply 24 V ac to ballast 1425. Dimmer 1503 is conventional from LEVITRON, 600 watt, 120 volt.

In FIG. 12, light path 1512 is a direct light path out of lamp 1400 from tube 1406, whereas light path 1513 is a reflected path due to the high reflectivity of styrofoam to 4500 kelvin cool white light.

In FIG. 14, transformer 11 supplies energy to each ballast e.g. 2000 (FIG. 13) hidden in the individual lamps 1400.

It may now be appriciated that miniturization of the ballast circuit permitted the creating of the light weight lamp and ceiling lighting for commecial and other buildings. Actually, the lamp light can be used as a light source for almoust any purpose.

For the specification disclosed, each lamp light emits 80 watts so that the ceiling of FIG. 14 emits 720 watts, but the light being cool white is the equivalent of much greater lumens.

Also, the neon light doesn't flicker because of the high frequency ballast and is healthier.

Since the neon bulb may last for 26 or more years, and the ballast is quite inexpensive, return to the factory can facillitate replacement of ballast or light fixture which will be repaired, simply.

Figure 11:
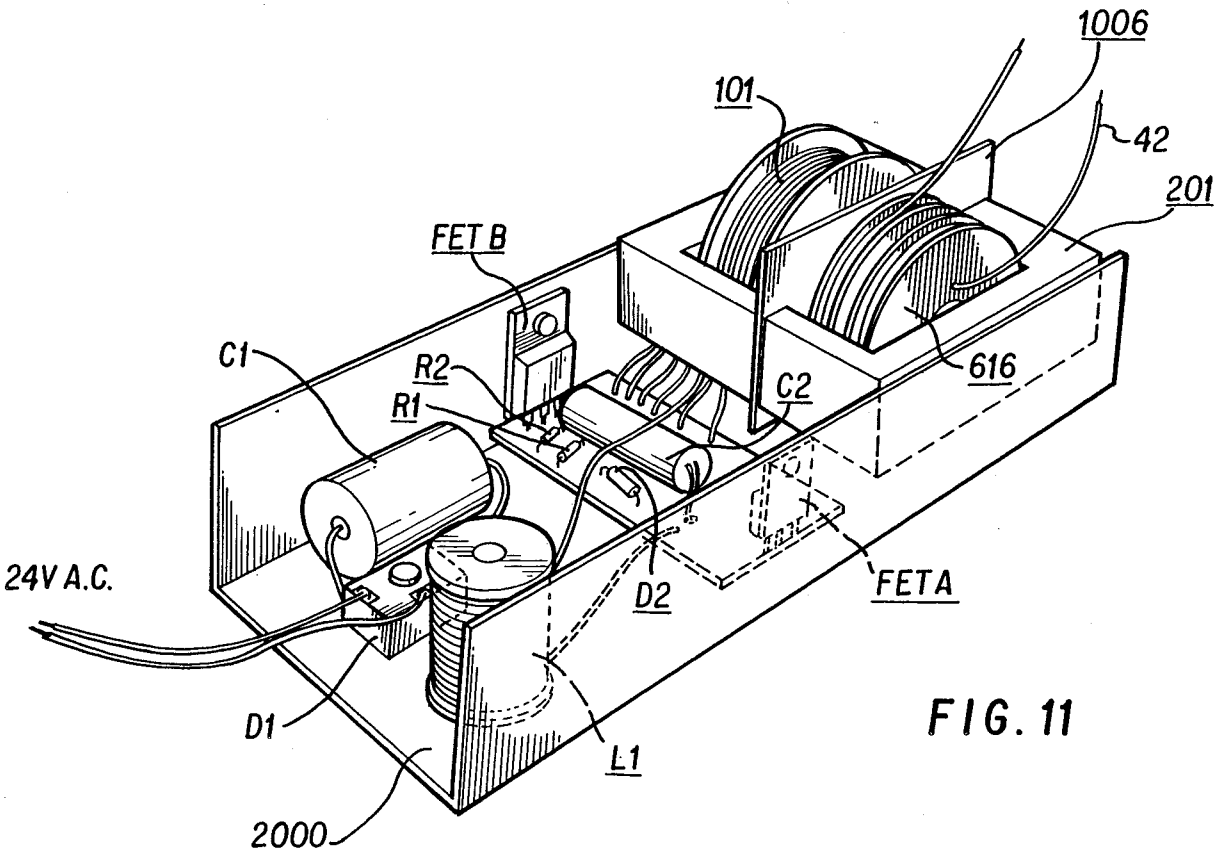
FIG. 11 shows the final assembly of the ballast in its heat sink housing.

In FIG. 11, the ballast is pictorially presented being 4" in length, 2" wide by 1¼" high including heat sink 2000. The physical parts are identified by the same numbers used in FIGS. 2 through 10.

What is claimed is:

1. A high frequency, low voltage ballast for a cold cathode tube, comprising in combination:

an output transformer having a secondary winding connected to supply power to said tube;

said transformer having a center tapped primary winding for inducing voltage across said secondary winding;

a pair of feedback windings adjacent the primary winding;

an E—E section core, each section comprising first outer leg, a second outer leg and a center leg;

a dielectric bobbin carrying said primary winding and said feedback windings all on the center leg of the first E core section;

a multi-section dielectric bobbin carrying the secondary winding mounted on the center leg of the other E core section with approximately one half of the secondary winding carried in a first section of the multi-section bobbin, and approximately the other half of the secondary winding carried by a different section of the multi-section bobbin in spaced apart relation to the first section;

a pair of switching FETS connected for alternate conduction to establish alternating current in the primary winding for inducing higher voltage alternating current in the secondary winding for operating the tube;

means for receiving a low voltage ac or dc supply voltage to operate the ballast;

means for biasing the FETS from rectified supply voltage; and means including said feedback windings for establishing said alternate conduction.

2. A high frequency, low voltage ballast for a cold cathode tube, comprising in combination:

an output transformer having a secondary winding connected to supply power to said tube;

said transformer having a center tapped primary winding for inducing voltage across said secondary winding;

a pair of feedback windings adjacent the primary winding;

an E—E section core, each section comprising first outer leg, a second outer leg and a center leg;

a dielectric bobbin carrying said primary winding and said feedback windings all on the center leg of the first E core section;

a further dielectric bobbin carrying the secondary winding mounted on the center leg of the other E core section;

a pair of switching means connected for alternate conduction to establish alternating current in the primary winding for inducing higher voltage alternating current in the secondary winding for operating the tube;

means for receiving a low voltage ac or dc supply voltage to operate the ballast;

means for biasing the switching means from rectified supply voltage; and means including said feedback windings for establishing said alternate conduction.

3. A method for high frequency, low voltage switching of an input ac or dc power to operate a cold cathode tube, comprising in the steps of:

using an E—E core for tightly coupling a secondary winding for supplying power to said tube;

energizing a center tapped primary winding for inducing voltage across said secondary winding;

providing feedback windings adjacent the primary winding;

providing an E—E section core, each section comprising first outer leg, a second outer leg and a center leg;

placing said primary winding and said feedback windings all on the center leg of the first E core section in a dielectric bobbin;

providing a multi-section dielectric bobbin for carrying the secondary winding mounted on the center leg of the other E core section;

providing a pair of switching means connected for alternate conduction to establish alternating current in the primary winding for inducing higher voltage alternating current in the secondary winding for operating the tube;

providing means for receiving a low voltage ac or dc supply voltage to operate the ballast;

providing means for biasing the FETs from rectified supply voltage; and providing means including said feedback windings for establishing said alternate conduction.

4. A high frequency, low voltage ballast for a cold cathode tube, comprising in combination:

an output transformer having a secondary winding connected to supply power to said tube;

said transformer having a center tapped primary winding for inducing voltage across said secondary winding;

a pair of feedback windings adjacent the primary winding;

an E—E section core, each section comprising first outer leg, a second outer leg and a center leg;

a dielectric bobbin carrying said primary winding and said feedback windings all on the center leg of the first E core section;

a multi-section dielectric bobbin carrying the secondary winding mounted on the center leg of the other E core section with approximately one half of the secondary winding carried in a first section of the multi-section bobbin, and approximately the other half of the secondary winding carried by a different section of the multi-section bobbin in spaced apart relation to the first section;

a pair of switching FETS connected for alternate conduction to establish alternating current in the primary winding for inducing higher voltage alternating current in the secondary winding for operating the tube;

means for receiving a low voltage ac or dc supply voltage to operate the ballast;

means for asymetrically biasing the FETS from rectified supply voltage with a selected FET receiving higher biassing voltage than the non-selected FET to insure that it always conducts first when the FETS are supplied with operating voltage; and means including said feedback windings for establishing said alternate conduction.

5. A dielectric bobbin for uniquely carrying a winding having substantially equal numbers of turns in each half thereof with a connecting turn extending between said halves comprising in combination;

a multi-section cylindrical bobbin having at least three sections and an axial opening there through;

said bobbin having a dielectric cylindrical core body and spaced apart dielectric peripheral spacers;

substantially half of said turns being wound about the core between a first and an adjacent second spaced apart spacer;

said connecting turn being wrapped about said core between said second spacer and a third spacer spaced apart therefrom; and, the other substantial half of said turns being wrapped about said core between said third spacer and a fourth spacer spaced therefrom.

6. The method of wrapping the winding of claim 5 on the core of claim 5, comprising the steps of:

wrapping the substantially half of said turns about the core between the first and second spacers in a clockwise direction;

wrapping the connecting turn about the core in a counter clockwise direction; and, wrapping the other substantial half of said turns about the core in a clockwise direction.

7. The method of claim 6, wherein:

said first mentioned substantially half of said turns penetrates said first spacer at a location adjacent the core to be wrapped between said first and second spacers outwardly of the core to the outer edge of said second spacer;

said connection turn extending over the second spacer via a peripheral groove and extending through said third spacer adjacent to the core; and said other substantial half of the winding being wrapped between said third and fourth spacer outwardly from the core.

* * * * *